US010366649B2

(12) United States Patent
Sung et al.

(10) Patent No.: US 10,366,649 B2
(45) Date of Patent: Jul. 30, 2019

(54) DISPLAY DEVICE AND METHOD OF OPERATING THE SAME

(71) Applicant: Samsung Display Co., Ltd., Yongin-si, Gyeonggi-do (KR)

(72) Inventors: Jeongmin Sung, Seoul (KR); Woo-Chul Kim, Seoul (KR); Youngmin Bae, Seoul (KR); Bong-Ju Jun, Seongnam-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 15/867,523

(22) Filed: Jan. 10, 2018

(65) Prior Publication Data

US 2018/0204502 A1 Jul. 19, 2018

(30) Foreign Application Priority Data

Jan. 17, 2017 (KR) ..... 10-2017-0007915

(51) Int. Cl.

| | |
|---|---|
| ***G09G 3/20*** | (2006.01) |
| ***G09G 5/12*** | (2006.01) |
| *G09G 5/00* | (2006.01) |

(52) U.S. Cl.

CPC ..... *G09G 3/2092* (2013.01); *G09G 5/12* (2013.01); *G09G 5/006* (2013.01); *G09G 2310/061* (2013.01); *G09G 2310/08* (2013.01); *G09G 2320/0247* (2013.01); *G09G 2320/103* (2013.01); *G09G 2330/021* (2013.01); *G09G 2340/0471* (2013.01); *G09G 2340/16* (2013.01); *G09G 2360/18* (2013.01); *G09G 2370/10* (2013.01)

(58) Field of Classification Search

CPC ..... G09G 3/2092; G09G 5/12; G09G 5/006; G09G 2310/061; G09G 2310/08; G09G 2320/0247; G09G 2320/103; G09G 2330/021; G09G 2340/0471; G09G 2340/16; G09G 2360/18; G09G 2370/10

See application file for complete search history.

(56) References Cited

U.S. PATENT DOCUMENTS

| | | | | |
|---|---|---|---|---|
| 9,865,194 | B2 * | 1/2018 | Koo | G09G 3/20 |
| 9,972,260 | B2 * | 5/2018 | Onishi | G09G 3/20 |

(Continued)

*Primary Examiner* — Peter D McLoone

(74) *Attorney, Agent, or Firm* — Lewis Roca Rothgerber Christie LLP

(57) ABSTRACT

A display device includes a source device to output image data in a normal mode and in a re-synchronization mode, and refrain from outputting the image data in a panel self-refresh mode, and a sink device to perform a displaying operation based on the image data in the normal mode, store the image data at a time when an operating mode is changed from the normal mode to the PSR mode, perform the displaying operation based on the still image data in the PSR mode, and perform a frame-timing synchronization operation in the re-synchronization mode in response to a PSR-exiting command, wherein the frame-timing synchronization operation includes a first period in which a length-change of a vertical blank period is measured, a second period in which a temporary panel on-off clock is determined, and a third period in which the temporary panel on-off clock is applied to the adjustment-target frame.

20 Claims, 10 Drawing Sheets

(56) References Cited

U.S. PATENT DOCUMENTS

| | | | | |
|---|---|---|---|---|
| 9,972,264 | B2 * | 5/2018 | Onishi | G09G 3/3648 |
| 10,102,817 | B2 * | 10/2018 | Onishi | G09G 3/20 |
| 10,115,376 | B2 * | 10/2018 | Yu | G09G 5/10 |
| 2016/0117995 | A1 | 4/2016 | Lee et al. | |
| 2016/0372077 | A1 * | 12/2016 | Koo | G09G 3/20 |
| 2016/0379580 | A1 * | 12/2016 | Onishi | G09G 3/20 345/690 |
| 2016/0379583 | A1 * | 12/2016 | Onishi | G09G 3/20 345/691 |
| 2016/0379584 | A1 * | 12/2016 | Onishi | G09G 3/3648 345/691 |
| 2017/0053625 | A1 * | 2/2017 | Yu | G09G 5/10 |
| 2017/0345395 | A1 * | 11/2017 | Shim | G09G 5/12 |
| 2018/0286333 | A1 * | 10/2018 | Inoue | G09G 3/3618 |

* cited by examiner

DISPLAY DEVICE AND METHOD OF OPERATING THE SAME

CROSS-REFERENCE TO RELATED APPLICATION

This application claims priority to, and the benefit of, Korean Patent Application No. 10-2017-0007915, filed on Jan. 17, 2017 in the Korean Intellectual Property Office (KIPO), the contents of which are incorporated herein in its entirety by reference.

BACKGROUND

1. Field

Embodiments relate generally to a display device.

2. Description of the Related Art

Recently, as mobile devices (e.g., a smart phone, a smart pad, etc.) become more widely used, many manufacturers try to install a display device that can provide a high-resolution image in the mobile device. Generally, the display device includes a source device and a sink device.

When the source device transmits image data input from an external component to the sink device, the sink device displays an image on a display panel based on the image data transmitted from the source device. Here, data transmission between the source device and the sink device results in power consumption. However, as the source device transmits still image data for displaying a still image that is not changed for each frame to the sink device each time, the mobile device that operates based on limited power (e.g., a battery, etc.) unnecessarily consumes power.

To overcome this problem, the video electronics standards association (VESA) suggested an embedded display port (eDP) interface that is designed for an electronic device including a display device. Particularly, an eDP v1.3 interface supports a panel self-refresh (PSR) function that reduces power consumption by implementing a still image based on still image data stored in a remote frame buffer (RFB) included in the sink device (e.g., based on the data transmission between the source device and the sink device stops).

However, a flicker that a user/viewer can perceive may be caused by a length-change of a vertical blank period of a given frame of the sink device due to a frame-timing synchronization operation performed in a re-synchronization mode. The length-change of the vertical blank period of the given frame also results in a length-change of the given frame when an operating mode is changed from a PSR mode to a normal mode through the re-synchronization mode in response to a PSR-exiting command during performance of the PSR function.

SUMMARY

Embodiments of the present inventive concept relate to a display device (e.g., an organic light emitting display (OLED) device, a liquid crystal display (LCD) device, etc.) that performs a panel self-refresh (PSR) function, and a method of operating the display device.

Some embodiments provide a display device that can reduce or prevent a flicker otherwise caused by a length-change of a vertical blank period of a given frame of a sink device due to a frame-timing synchronization operation performed in a re-synchronization mode when an operating mode is changed from a PSR mode to a normal mode through the re-synchronization mode in response to a PSR-exiting command in performing a PSR function.

Some embodiments provide a method of operating the display device.

According to embodiments, a display device may include a source device configured to output image data in a normal mode and in a re-synchronization mode, and refrain from outputting the image data in a panel self-refresh (PSR) mode, and a sink device configured to perform a displaying operation based on the image data in the normal mode, store the image data as still image data in a remote frame buffer at a time when an operating mode is changed from the normal mode to the PSR mode in response to a PSR-entering command, perform the displaying operation based on the still image data in the PSR mode, and perform a frame-timing synchronization operation for synchronizing a frame timing of the sink device with a frame timing of the source device in the re-synchronization mode when the operating mode is changed from the PSR mode to the normal mode through the re-synchronization mode in response to a PSR-exiting command, wherein the frame-timing synchronization operation includes a first period in which a length-change of a vertical blank period of an adjustment-target frame of the sink device is measured, a second period in which a temporary panel on-off clock to be applied to the adjustment-target frame is determined by reflecting the length-change to equalize a panel-on-time ratio of the adjustment-target frame with a panel-on-time ratio of a normal frame of the sink device, and a third period in which the temporary panel on-off clock is applied to the adjustment-target frame when the adjustment-target frame is implemented.

The source device may be further configured to cease outputting the image data to the sink device when the PSR mode is started in response to the PSR-entering command, and begin outputting the image data to the sink device when the re-synchronization mode is started in response to the PSR-exiting command.

The sink device may be configured to continue to perform the displaying operation based on the still image data before the operating mode is changed from the re-synchronization mode to the normal mode.

A duty ratio of the temporary panel on-off clock is equal to a duty ratio of the panel on-off clock.

The first period may be from a first rising edge of the image data output from the source device to a second rising edge of the still image data output from the remote frame buffer when the frame timing of the source device leads the frame timing of the sink device.

The second period may be from the second rising edge of the still image data output from the remote frame buffer to a third rising edge of the still image data output from the remote frame buffer when the frame timing of the source device leads the frame timing of the sink device.

The third period may be from the third rising edge of the still image data output from the remote frame buffer to a fourth rising edge of the image data output from the source device when the frame timing of the source device leads the frame timing of the sink device.

A pulse width of the temporary panel on-off clock may be smaller than a pulse width of a panel on-off clock applied to the normal frame in the PSR mode, in the normal mode, and in the first and second periods of the re-synchronization mode when the frame timing of the source device leads the frame timing of the sink device.

The first period may be from a first rising edge of the image data output from the source device to a second rising edge of the image data output from the source device when the frame timing of the source device lags behind the frame timing of the sink device.

The second period may be from the second rising edge of the image data output from the source device to a second rising edge of the still image data output from the remote frame buffer when the frame timing of the source device lags behind the frame timing of the sink device.

The third period may be from the second rising edge of the still image data output from the remote frame buffer to a fourth rising edge of the image data output from the source device when the frame timing of the source device lags behind the frame timing of the sink device.

A pulse width of the temporary panel on-off clock may be larger than a pulse width of a panel on-off clock applied to the normal frame in the PSR mode, in the normal mode, and in the first and second periods of the re-synchronization mode when the frame timing of the source device lags behind the frame timing of the sink device.

According to embodiments, a method of operating a display device of which an operating mode is changed from a PSR mode to a normal mode through a re-synchronization mode in performing a panel self-refresh (PSR) function may include controlling a sink device to perform a displaying operation based on still image data stored in a remote frame buffer of the sink device in the PSR mode, controlling the sink device to measure a length-change of a vertical blank period of an adjustment-target frame of the sink device in the re-synchronization mode, controlling the sink device to determine a temporary panel on-off clock to be applied to the adjustment-target frame by reflecting the length-change to equalize a panel-on-time ratio of the adjustment-target frame with a panel-on-time ratio of a normal frame of the sink device in the re-synchronization mode, controlling the sink device to apply the temporary panel on-off clock to the adjustment-target frame when the adjustment-target frame is implemented in the re-synchronization mode, and controlling the sink device to perform the displaying operation based on image data output from a source device in the normal mode.

A duty ratio of the temporary panel on-off clock may be equal to a duty ratio of the panel on-off clock.

The method may further include controlling the sink device to measure the length-change during a period from a first rising edge of the image data output from the source device to a second rising edge of the still image data output from the remote frame buffer when a frame timing of the source device leads a frame timing of the sink device.

The method may further include controlling the sink device to determine the temporary panel on-off clock during a period from the second rising edge of the still image data output from the remote frame buffer to a third rising edge of the still image data output from the remote frame buffer when the frame timing of the source device leads the frame timing of the sink device.

The method may further include controlling the sink device to apply the temporary panel on-off clock to the adjustment-target frame during a period from the third rising edge of the still image data output from the remote frame buffer to a fourth rising edge of the image data output from the source device when the frame timing of the source device leads the frame timing of the sink device.

The method may further include controlling the sink device to measure the length-change during a period from a first rising edge of the image data output from the source device to a second rising edge of the image data output from the source device when a frame timing of the source device lags behind a frame timing of the sink device.

The method may further include controlling the sink device to determine the temporary panel on-off clock during a period from the second rising edge of the image data output from the source device to a second rising edge of the still image data output from the remote frame buffer when the frame timing of the source device lags behind the frame timing of the sink device.

The method may further include controlling the sink device to apply the temporary panel on-off clock to the adjustment-target frame during a period from the second rising edge of the still image data output from the remote frame buffer to a fourth rising edge of the image data output from the source device when the frame timing of the source device lags behind the frame timing of the sink device.

Therefore, a display device according to embodiments may divide (as an operating mode is changed from a PSR mode to a normal mode through a re-synchronization mode in response to a PSR-exiting command in performing a PSR function) a frame-timing synchronization operation performed in the re-synchronization mode into a first period, in which a length-change of a vertical blank period of an adjustment-target frame of a sink device is measured, a second period, in which a temporary panel on-off clock to be applied to the adjustment-target frame of the sink device is determined by reflecting the length-change of the vertical blank period of the adjustment-target frame of the sink device to equalize a panel-on-time ratio of the adjustment-target frame of the sink device with a panel-on-time ratio of a normal frame of the sink device, and a third period, in which the temporary panel on-off clock is applied to the adjustment-target frame of the sink device when the adjustment-target frame of the sink device is implemented. Thus, the display device may reduce or prevent a flicker due to a length-change of a vertical blank period of a given frame (e.g., the adjustment-target frame) of a sink device, which is caused in a re-synchronization mode of a conventional display device.

In addition, a method of operating a display device according to embodiments, where an operating mode of the display device is changed from a PSR mode to a normal mode through a re-synchronization mode in performing a PSR function, may enable control of a sink device to perform a displaying operation based on still image data stored in a remote frame buffer of the sink device in the PSR mode, may enable control of the sink device to measure a length-change of a vertical blank period of an adjustment-target frame of the sink device in the re-synchronization mode, may enable control of the sink device to determine a temporary panel on-off clock to be applied to the adjustment-target frame of the sink device by reflecting the length-change of the vertical blank period of the adjustment-target frame of the sink device to equalize a panel-on-time ratio of the adjustment-target ratio of the sink device with a panel-on-time ratio of a normal frame of the sink device in the re-synchronization mode, may enable control of the sink device to apply the temporary panel on-off clock when the adjustment-target frame of the sink device is implemented in the re-synchronization mode, and may enable control of the sink device to perform a displaying operation based on image data output from a source device in the normal mode. Thus, the method may reduce or prevent a flicker due to a length-change of a vertical blank period of a given frame of a sink device, which is caused in a re-synchronization mode of a conventional display device.

BRIEF DESCRIPTION OF THE DRAWINGS

Illustrative, non-limiting embodiments will be more clearly understood from the following detailed description in conjunction with the accompanying drawings.

DETAILED DESCRIPTION

Figure 1:
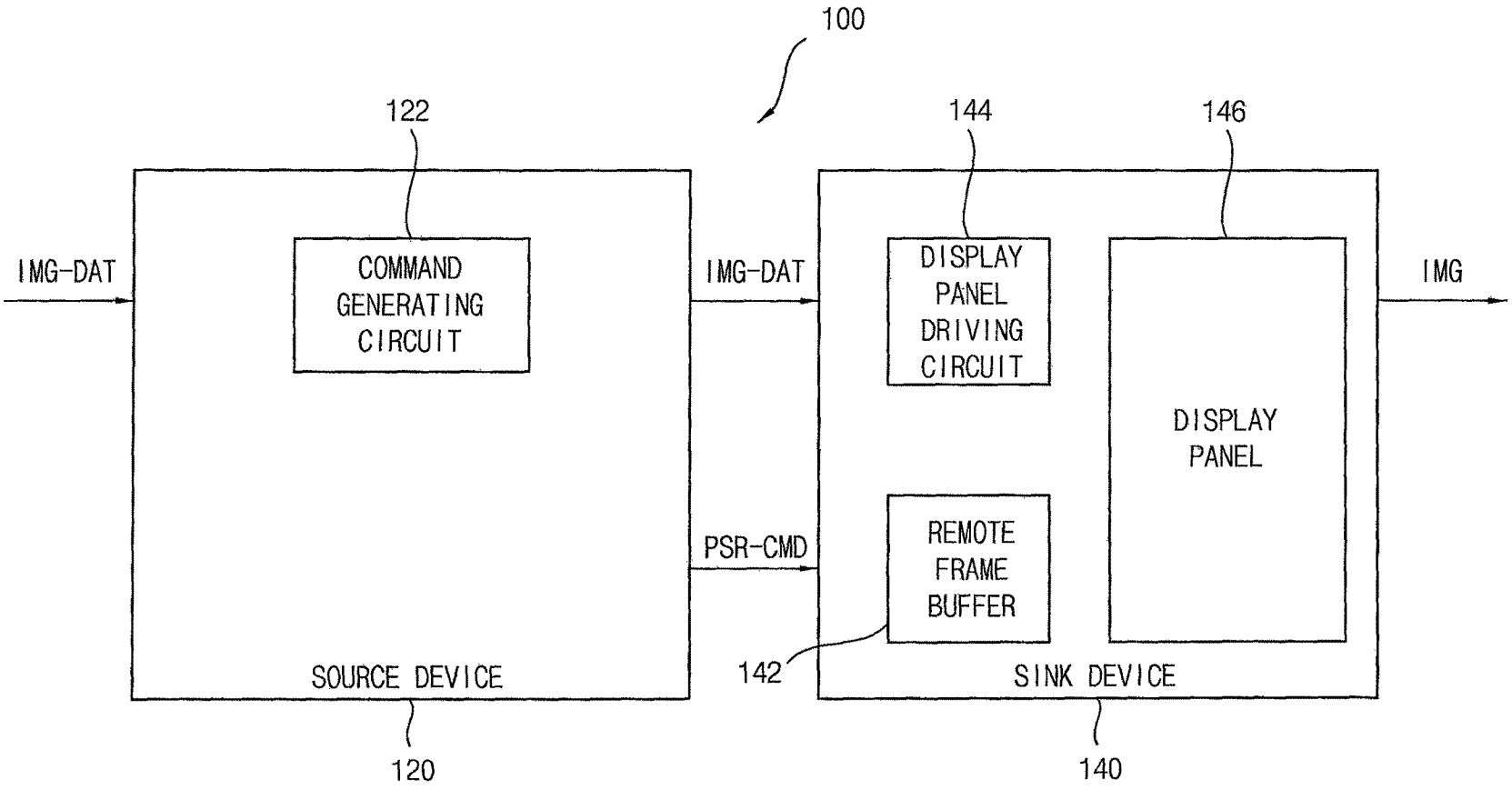
FIG. 1 is a block diagram illustrating a display device according to embodiments.

Features of the inventive concept and methods of accomplishing the same may be understood more readily by reference to the following detailed description of embodiments and the accompanying drawings. Hereinafter, embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

In the following description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. In addition, it will also be understood that when an element or layer is referred to as being "between" two elements or layers, it can be the only element or layer between the two elements or layers, or one or more intervening elements or layers may also be present.

For the purposes of this disclosure, expressions such as "at least one of," when preceding a list of elements, modify the entire list of elements and do not modify the individual elements of the list. For example, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

When a certain embodiment may be implemented differently, a specific process order may be performed differently from the described order. For example, two consecutively described processes may be performed substantially at the same time or performed in an order opposite to the described order.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Thus, embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
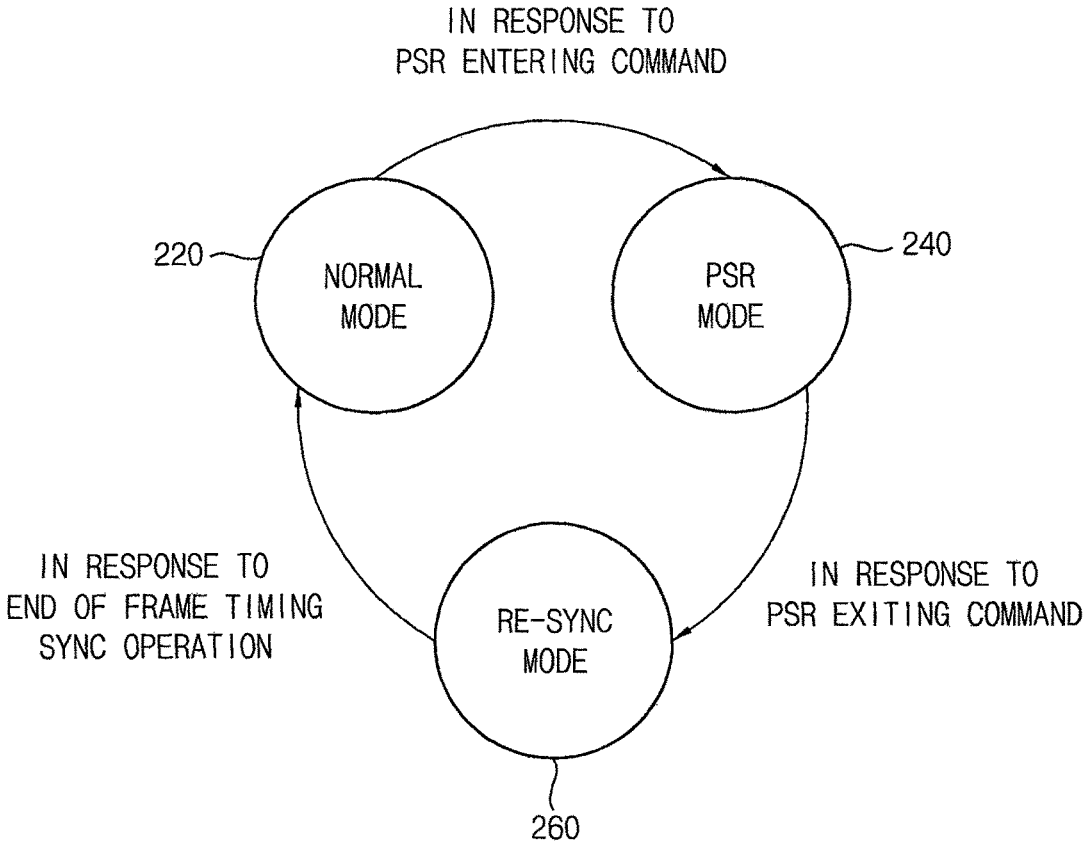
FIG. 2 is a diagram illustrating an operating mode of the display device of FIG. 1.
Figure 3:
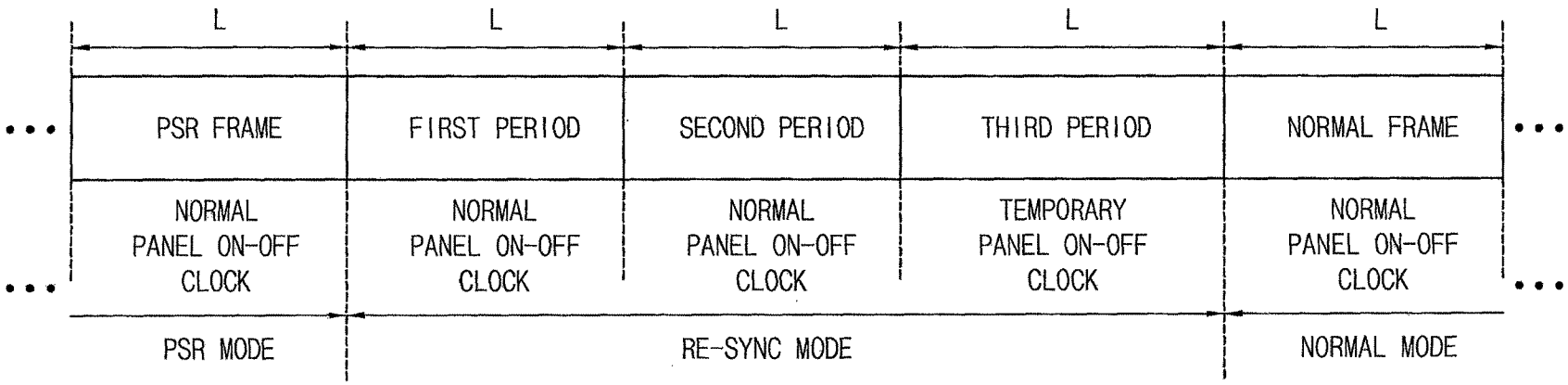
FIG. 3 is a diagram for describing a process in which the display device of FIG. 1 performs a frame-timing synchronization operation.

FIG. 1 is a block diagram illustrating a display device according to embodiments. FIG. 2 is a diagram illustrating an operating mode of the display device of FIG. 1. FIG. 3 is a diagram for describing a process in which the display device of FIG. 1 performs a frame-timing synchronization operation.

Referring to FIGS. 1 to 3, the display device 100 may include a source device 120 and a sink device 140. Here, the source device 120 and the sink device 140 may perform data transmission based on an eDP interface, and may perform a PSR function that the eDP interface supports. However, an interface between the source device 120 and the sink device 140 for performing the PSR function is not limited to the eDP interface.

The source device 120 may output image data IMG-DAT in a normal mode 220 and in a re-synchronization mode 260, but might not output (e.g., may refrain from outputting) the image data IMG-DAT in a PSR mode 240. In other words, data transmission may be performed between the source device 120 and the sink device 140 in the normal mode 220 and the re-synchronization mode 260 (e.g., the eDP interface is activated), but the data transmission might not be performed between the source device 120 and the sink device 140 in the PSR mode 240 (e.g., when the eDP interface is deactivated).

For example, the source device 120 may receive the image data IMG-DAT input from an external component, may determine whether the image data IMG-DAT is non-still image data for displaying a non-still image IMG that is changed for each frame, or is still image data for displaying a still image IMG that is not changed for each frame, may operate in the normal mode 220 when the image data IMG-DAT is determined to be the non-still image data, and may operate in the PSR mode 240 when the image data IMG-DAT is determined to be the still image data.

In an embodiment, the source device 120 may include a command generating circuit 122 that generates a PSR command PSR-CMD. Here, the PSR command PSR-CMD may be a PSR-entering command or a PSR-exiting command. That is, the source device 120 may cease/stop outputting the image data IMG-DAT to the sink device 140 when the PSR mode 240 is started in response to the PSR-entering command, and may begin outputting the image data IMG-DAT to the sink device 140 when the re-synchronization mode 260 is started in response to the PSR-exiting command.

For example, the command generating circuit 122 may generate the PSR-entering command to transmit the PSR-entering command to the sink device 140 when the image data IMG-DAT input from the external component is determined to be the still image data while the source device 120 operates in the normal mode 220. As a result, the source device 120 and the sink device 140 may exit the normal mode 220 and may enter the PSR mode 240. On the other hand, the command generating circuit 122 may generate the PSR-exiting command to transmit the PSR-exiting command to the sink device 140 when the image data IMG-DAT input from the external component is determined to be the non-still image data while the source device 120 operates in the PSR mode 240. As a result, the source device 120 and the sink device 140 may exit the PSR mode 240 and may enter the normal mode 220 through the re-synchronization mode 260.

Although it is illustrated in FIG. 1 that the source device 120 includes only the command generating circuit 122, it should be understood that the source device 120 may further include other components (e.g., a processor, a frame buffer memory, a transmitting circuit, etc.).

The sink device 140 may perform a displaying operation based on the image data IMG-DAT output from the source device 120 in the normal mode 220, may store the image data IMG-DAT as the still image data in a remote frame buffer 142 at a time when the operating mode is changed from the normal mode 220 to the PSR mode 240 in response to the PSR-entering command, and may perform a displaying operation based on the still image data output from the remote frame buffer 142 in the PSR mode 240.

In an embodiment, the sink device 140 may include the remote frame buffer 142, a display panel driving circuit 144, and a display panel 146. Thus, in the normal mode 220, the display panel driving circuit 144 may receive the image data IMG-DAT (e.g., the non-still image data) output from the source device 120, and may display the non-still image IMG on the display panel 146 based on the non-still image data. On the other hand, in the PSR mode 240, the display panel driving circuit 146 may receive the still image data output from the remote frame buffer 142, and may display the still image IMG on the display panel 146 based on the still image data.

As described above, the source device 120 and the sink device 140 operate in the re-synchronization mode 260 between the PSR mode 240 and the normal mode 220 when the operating mode is changed from the PSR mode 240 to the normal mode 220. Generally, in the PSR mode 240, the data transmission between the source device 120 and the sink device 140 may be stopped (e.g., the data transmission may not be performed between the source device 120 and the sink device 140), and thus the source device 120 and the sink device 140 may operate independently. Thus, the sink device 140 may perform a frame-timing synchronization operation for synchronizing a frame timing of the sink device 140 with a frame timing of the source device 120 in the re-synchronization mode 260 as the operating mode is changed from the PSR mode 240 to the normal mode 220 through the re-synchronization mode 260 in response to the PSR-exiting command.

Here, in the re-synchronization mode 260, the display panel driving circuit 144 may receive the still image data output from the remote frame buffer 142, and may display the still image IMG on the display panel 146 based on the still image data. In other words, the sink device 140 may continue to perform a displaying operation based on the still image data output from the remote frame buffer 142 before the operation mode is changed from the re-synchronization mode 260 to the normal mode 220.

Although it is illustrated in FIG. 2 that the sink device 140 includes the remote frame buffer 142, the display panel driving circuit 144, and the display panel 146, it should be understood that the sink device 140 may further include other components (e.g., a remote frame buffer control circuit, a receiving circuit, etc.).

As the operating mode is changed from the PSR mode 240 to the normal mode 220 through the re-synchronization mode 260 in performing the PSR function, a conventional display device needs to increase or decrease a given frame of the sink device 140 to perform the frame-timing synchronization operation (e.g., to synchronize the frame timing of the sink device 140 with the frame timing of the source device 120) in the re-synchronization mode 260. Thus, a length of a vertical blank period of the given frame of the sink device 140 is changed. Here, because the sink device 140 continues to perform a displaying operation based on the still image data output from the remote frame buffer 142 in the re-synchronization mode 260, the length-change of the vertical blank period of the given frame of the sink device 140 results in the luminance-change of the given frame. Thus, a flicker that a user/viewer can perceive may be caused by the length-change of the vertical blank period of the given frame of the sink device 140. To overcome this problem, the display device 100 may divide (as the operating mode is changed from the PSR mode 240 to the normal mode 220 through the re-synchronization mode 260 in response to the PSR-exiting command in performing the PSR function) the frame-timing synchronization operation performed in the re-synchronization mode 260 into a first period (e.g., indicated by FIRST PERIOD in FIG. 3) in which a length-change of a vertical blank period of an adjustment-target frame of the sink device 140 is measured, a second period (e.g., indicated by SECOND PERIOD) in which a temporary panel on-off clock to be applied to the adjustment-target frame of the sink device 140 is determined by reflecting the length-change of the vertical blank period of the adjustment-target frame of the sink device 140 to equalize a panel-on-time ratio of the adjustment-target frame of the sink device 140 with a panel-on-time ratio of a normal frame of the sink device 140, and a third period (e.g., indicated by THIRD PERIOD) in which the temporary panel on-off clock is applied to the adjustment-target frame of the sink device 140 when the adjustment-target frame of the sink device 140 is implemented.

Here, the panel-on-time ratio of the adjustment-target frame of the sink device 140 may be equalized with the panel-on-time ratio of the normal frame of the sink device 140, although a length L of the normal frame of the sink device 140 is different from a length L' of the adjustment-target frame of the sink device 140. That is, a duty ratio of the temporary panel on-off clock applied to the adjustment-target frame of the sink device 140 may be equalized with a duty ratio of the panel on-off clock applied to the normal frame of the sink device 140, although a pulse width of the panel on-off clock applied to the normal frame of the sink device 140 is different from a pulse width of the temporary panel on-off clock applied to the adjustment-target frame of the sink device 140. Thus, luminance of the normal frame of the sink device 140 may be equal to luminance of the adjustment-target frame of the sink device 140. As a result, a flicker that a user may otherwise perceive may not be caused, even though the length-change of the vertical blank period of the adjustment-target frame of the sink device 140 occurs.

In some embodiments, when the sink device 140 performs the frame-timing synchronization operation for synchronizing the frame timing of the sink device 140 with the frame timing of the source device 120 in the re-synchronization mode 260, there are two cases (e.g., a case in which the frame timing of the source device 120 leads the frame timing of the sink device 140, and a case in which the frame timing of the source device 120 lags behind the frame timing of the sink device 140). The two different cases correspond to a timing of the PSR-exiting command.

Here, when the frame timing of the source device 120 leads the frame timing of the sink device 140, the pulse width of the temporary panel on-off clock may be smaller than the pulse width of the panel on-off clock applied to the normal frame in the PSR mode 240, in the normal mode 220, and in the first and second periods of the re-synchronization mode 260. On the other hand, when the frame timing of the source device 120 lags behind the frame timing of the sink device 140, the pulse width of the temporary panel on-off clock may be larger than the pulse width of the panel on-off clock applied to the normal frame in the PSR mode 240, in the normal mode 220, and in the first and second periods of the re-synchronization mode 260. The two cases will be described in detail with reference to FIGS. 4 to 7.

In some embodiments, the display panel 146 included in the sink device 140 may include a plurality of pixels. For example, the display panel 146 included in the sink device 140 may be an organic light emitting display panel or a liquid crystal display panel. However, the display panel 146 included in the sink device 140 is not limited thereto. In addition, the display panel driving circuit 144 included in the sink device 140 may include a scan driver that provides a scan signal to the display panel 146, a data driver that provides a data signal to the display panel 146, a timing controller that controls the scan driver and the data driver, etc. However, components of the display panel driving circuit 144 are not limited thereto. In some embodiments, the remote frame buffer control circuit that controls the remote frame buffer 142 may be implemented inside or outside the display panel driving circuit 144.

Figure 4:
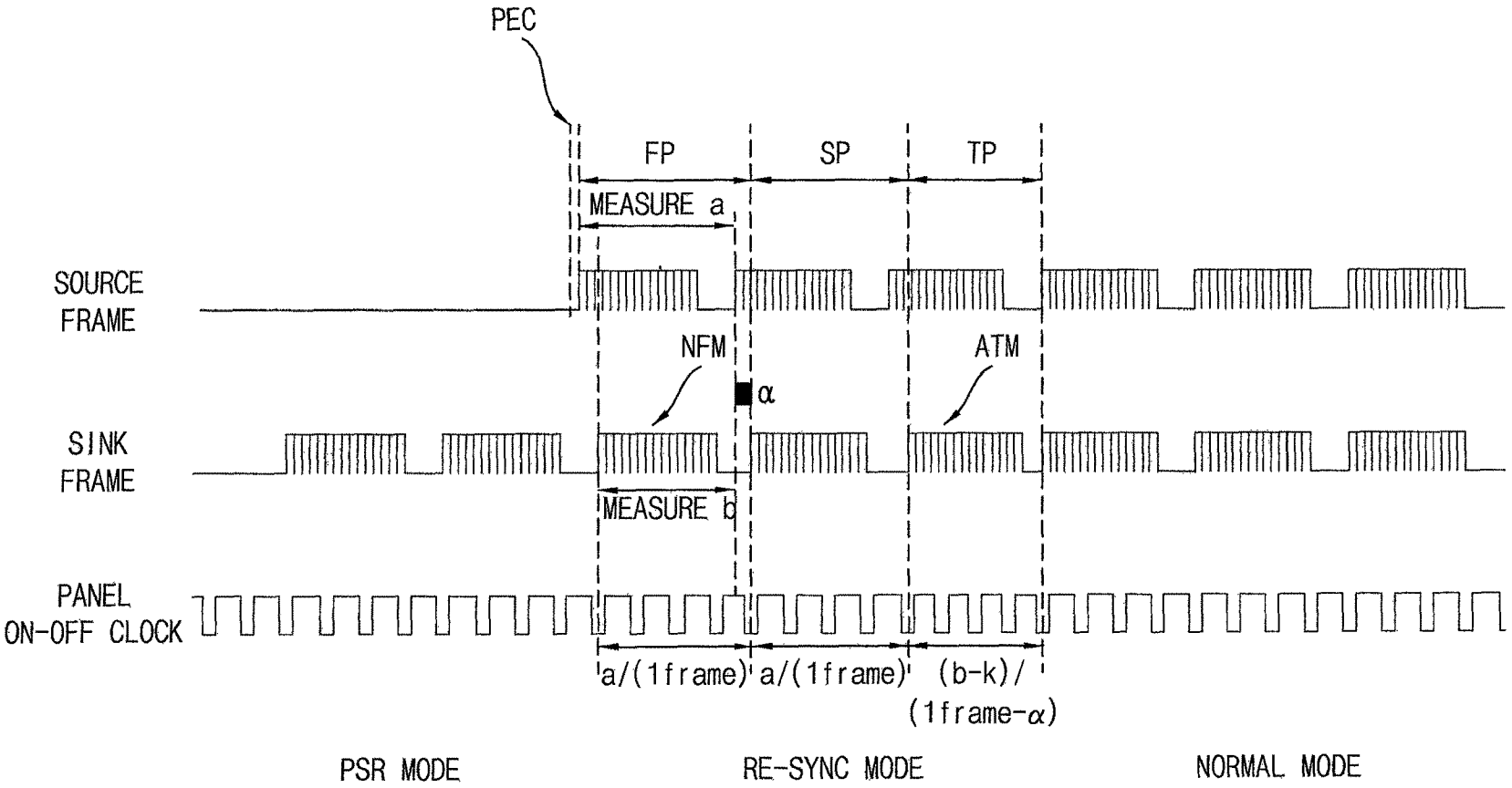
FIG. 4 is a diagram illustrating an example in which the display device of FIG. 1 performs a frame-timing synchronization operation when a frame timing of a source device leads/precedes a frame timing of a sink device.
Figure 5:
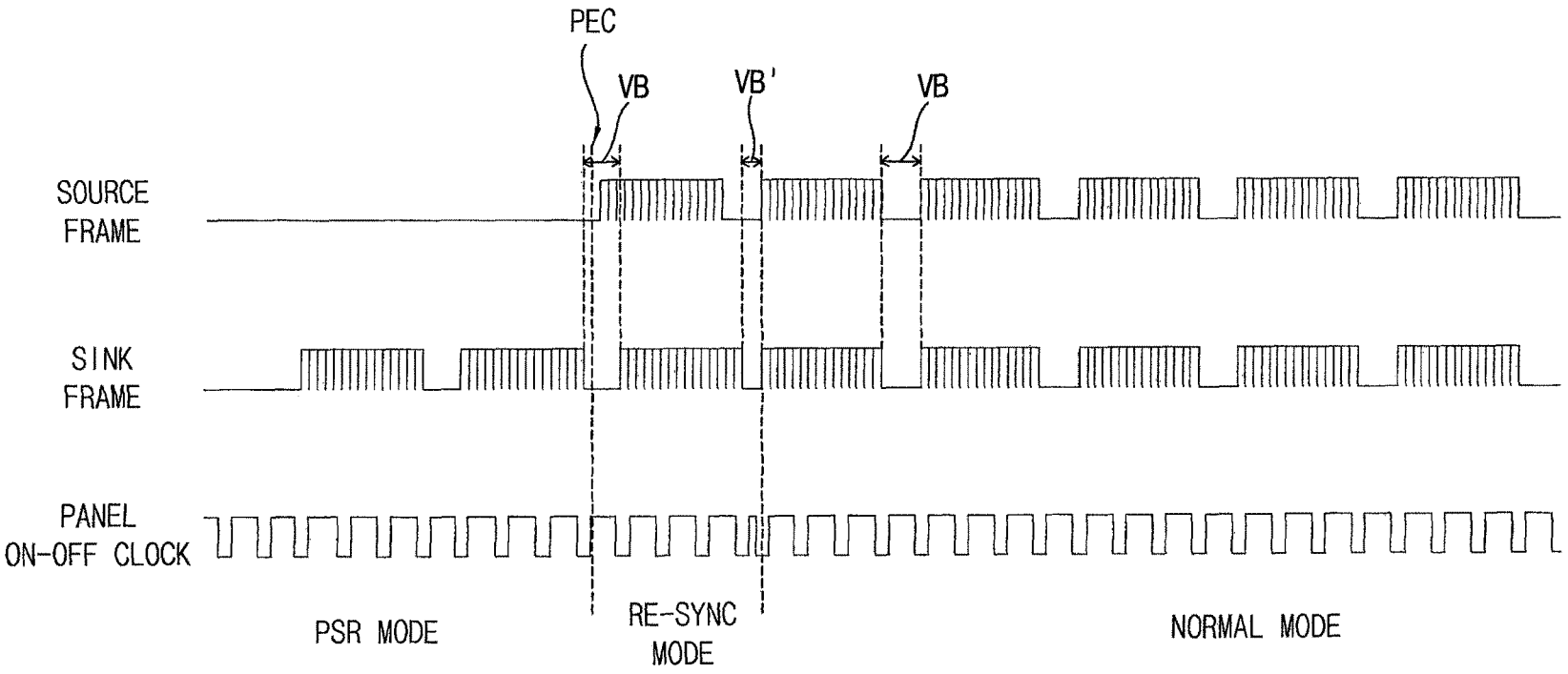
FIG. 5 is a diagram illustrating an example in which a conventional display device performs a frame-timing synchronization operation when a frame timing of a source device leads a frame timing of a sink device.

FIG. 4 is a diagram illustrating an example in which the display device of FIG. 1 performs a frame-timing synchronization operation when a frame timing of a source device leads/precedes a frame timing of a sink device. FIG. 5 is a diagram illustrating an example in which a conventional display device performs a frame-timing synchronization operation when a frame timing of a source device leads a frame timing of a sink device.

Referring to FIGS. 4 and 5, the frame-timing synchronization operation may be performed when the frame timing of the source device 120 leads the frame timing of the sink device 140. That is, after the operating mode of the display device 100 is changed from the PSR mode 240 to the re-synchronization mode 260 as the PSR-exiting command PEC is generated, a rising edge of the image data (e.g., see SOURCE FRAME), which is output from the source device 120, may lead a rising edge of the still image data (e.g., see SINK FRAME), which is output from the remote frame buffer 142 of the sink device 140.

As illustrated in FIG. 5, after the operating mode is changed from the PSR mode to the re-synchronization mode as the PSR-exiting command PEC is generated, the conventional display device needs to reduce a length of a vertical blank period of a frame of the sink device (e.g., the reduction of the length of the vertical blank period being indicated by VB and VB') because the conventional display device may reduce a length of the given frame of the sink device to synchronize the frame timing of the sink device with the frame timing of the source device in the re-synchronization mode when the frame timing of the source device leads the frame timing of the sink device. However, in the conventional display device, because the panel on-off clock is distorted (e.g., sharply contracted) in the vertical blank period of the given frame without changing a panel-on-time ratio of the panel on-off clock, luminance of the given frame is changed, and thus a flicker that a user can perceive is caused.

On the other hand, the display device 100 of the present embodiment may reduce or prevent the flicker due to the length-change of the vertical blank period of the given frame of the sink device, which is caused in the re-synchronization mode of the conventional display device, by dividing the frame-timing synchronization operation performed in the re-synchronization mode 260 into a first period FP, in which a length-change $\alpha$ of a vertical blank period of an adjustment-target frame ATM of the sink device 140 is measured, a second period SP, in which a temporary panel on-off clock (e.g., indicated by PANEL ON-OFF CLOCK) to be applied to the adjustment-target frame ATM of the sink device 140 is determined by reflecting the length-change $\alpha$ to equalize a panel-on-time ratio of the adjustment-target frame ATM of the sink device 140 with a panel-on-time ratio of a normal frame NFM of the sink device 140, and a third period TP, in which the temporary panel on-off clock is applied to the adjustment-target frame ATM of the sink device 140 when the adjustment-target frame ATM of the sink device 140 is implemented.

For example, as illustrated in FIG. 4, the first period FP may be from a first rising edge of the image data output from the source device 120 to a second rising edge of the still image data output from the remote frame buffer 142 of the sink device 140. That is, the first period FP may include one frame of the image data output from the source device 120, and one frame of the still image data (e.g., the normal frame NFM of the sink device 140) output from the remote frame buffer 142 of the sink device 140.

During the first period FP, the length-change $\alpha$ of the vertical blank period of the adjustment-target frame ATM of the sink device 140 may be measured. That is, the length-change $\alpha$ may be a period from a second rising edge of the image data output from the source device 120 to a second rising edge of the still image data output from the remote frame buffer 142 of the sink device 140, and a length of the adjustment-target frame ATM of the sink device 140 may be a value generated by subtracting the length-change $\alpha$ from a length of the normal frame NFM of the sink device 140.

During the first period FP, a panel-on-time (e.g., a panel-on length of time) a of one frame of the source device 120 may be measured (e.g., indicated by MEASURE a), and a panel-on-time b of the adjustment-target frame ATM of the sink device 140 may be measured (e.g., indicated by MEASURE b). Here, the panel-on-time a of the normal frame NFM of the sink device 140 may be substantially the same as the panel-on-time a of one frame of the source device 120.

In addition, as illustrated in FIG. 4, the second period SP may be from the second rising edge of the still image data output from the remote frame buffer 142 of the sink device 140 to a third rising edge of the still image data output from the remote frame buffer 142 of the sink device 140. That is, the second period SP may include one frame of the still image data (e.g., the normal frame NFM of the sink device 140) output from the remote frame buffer 142 of the sink device 140.

During the second period SP, the temporary panel on-off clock to be applied to the adjustment-target frame ATM of the sink device 140 may be determined by reflecting the length-change $\alpha$ to equalize the panel-on-time ratio of the adjustment-target frame ATM of the sink device 140 (e.g., $(b-k)/(1\text{frame}-\alpha)$) with the panel-on-time ratio of the normal frame NFM of the sink device 140 (e.g., a/1frame). In other words, because the length of the normal frame NFM of the sink device 140 (e.g., 1frame) and the panel-on-time b of the adjustment-target frame ATM of the sink device 140 are grasped (i.e., known, figured out, etc), a variable k that satisfies an equation $a/1\text{frame}=(b-k)/(1\text{frame}-\alpha)$ may be calculated or obtained when the length-change $\alpha$ is reflected. Here, the panel-on-time of the temporary panel on-off clock to be applied to the adjustment-target frame ATM of the sink device 140 may be (b−k). Thus, the pulse width of the temporary panel on-off clock to be applied to the adjustment-target frame ATM of the sink device 140 in the third period TP may be smaller than the pulse width of the panel on-off clock applied to the normal frame NFM of the sink device 140 in the PSR mode 240, in the normal mode 220, and in the first and second periods FP and SP of the re-synchronization mode 260.

Further, as illustrated in FIG. 4, the third period TP may be from the third rising edge of the still image data output from the remote frame buffer 142 of the sink device 140 to a fourth rising edge of the image data output from the source device 120. That is, the third period TP may include the adjustment-target frame ATM of the sink device 140.

During the third period TP, the temporary panel on-off clock may be applied to the adjustment-target frame ATM of the sink device 140. As a result, the panel-on-time ratio of the adjustment-target frame ATM of the sink device 140 may be equalized with the panel-on-time ratio of the normal frame NFM of the sink device 140 even though the length of the adjustment-target frame ATM of the sink device 140 is different from the length of the normal frame NFM of the sink device 140. That is, the duty ratio of the temporary panel on-off clock applied to the adjustment-target frame ATM of the sink device 140 may be equalized with the duty ratio of the panel on-off clock applied to the normal frame NFM of the sink device 140 even though the pulse width of the panel on-off clock applied to the normal frame NFM of the sink device 140 is different from the pulse width of the temporary panel on-off clock applied to the adjustment-target frame ATM of the sink device 140. Thus, luminance of the normal frame NFM of the sink device 140 may be equal to luminance of the adjustment-target frame ATM of the sink device 140. As a result, a flicker that a user can otherwise perceive may not be caused even though the length-change of the vertical blank period of the adjustment-target frame ATM of the sink device 140 occurs. Next, as the operating mode of the display device 100 is changed from the re-synchronization mode 260 to the normal mode 220 at a time when the third period TP ends, the sink device 140 may perform a displaying operation based on the image data output from the source device 120.

Figure 6:
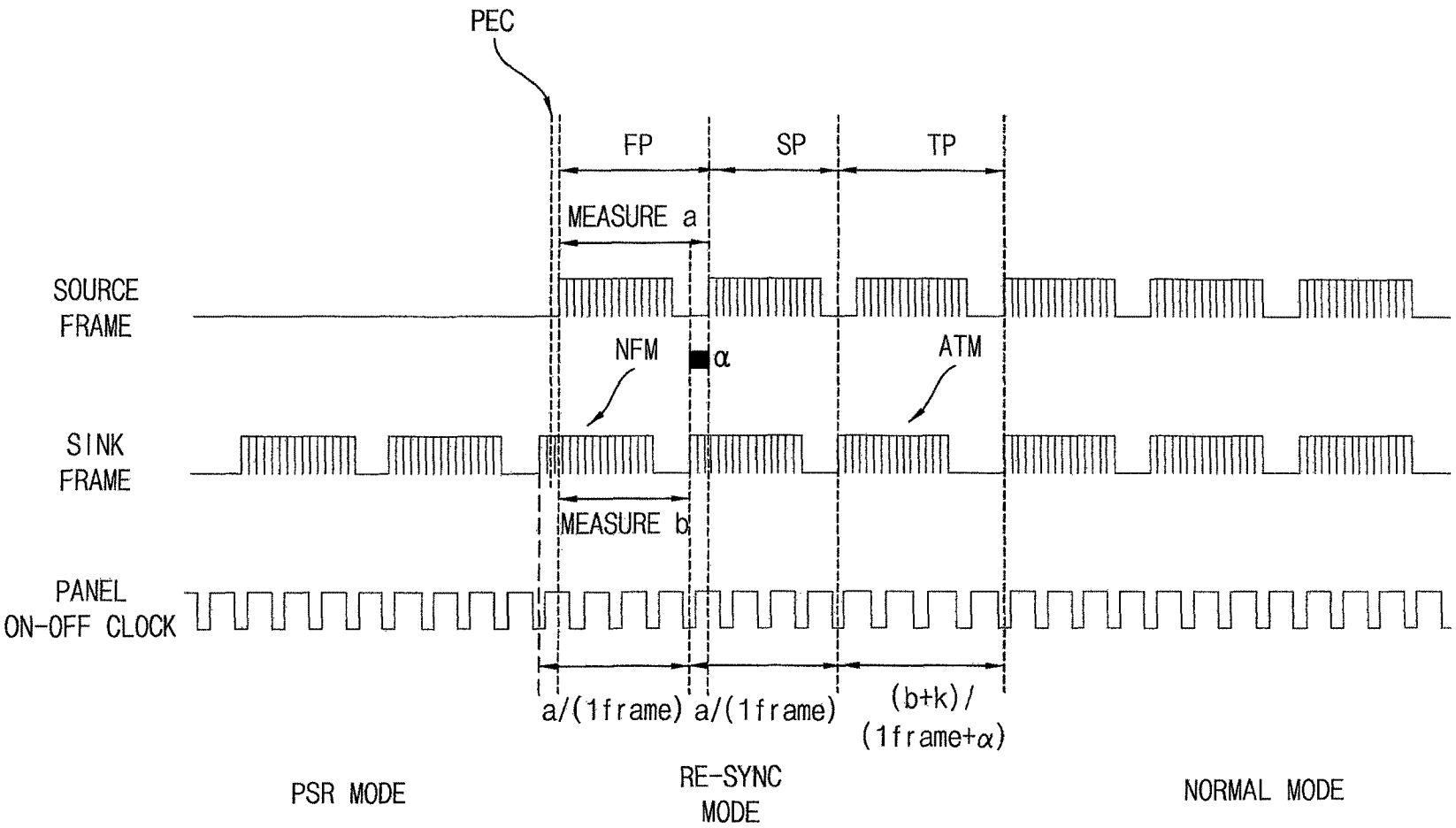
FIG. 6 is a diagram illustrating an example in which the display device of FIG. 1 performs a frame-timing synchronization operation when a frame timing of a source device lags behind a frame timing of a sink device.
Figure 7:
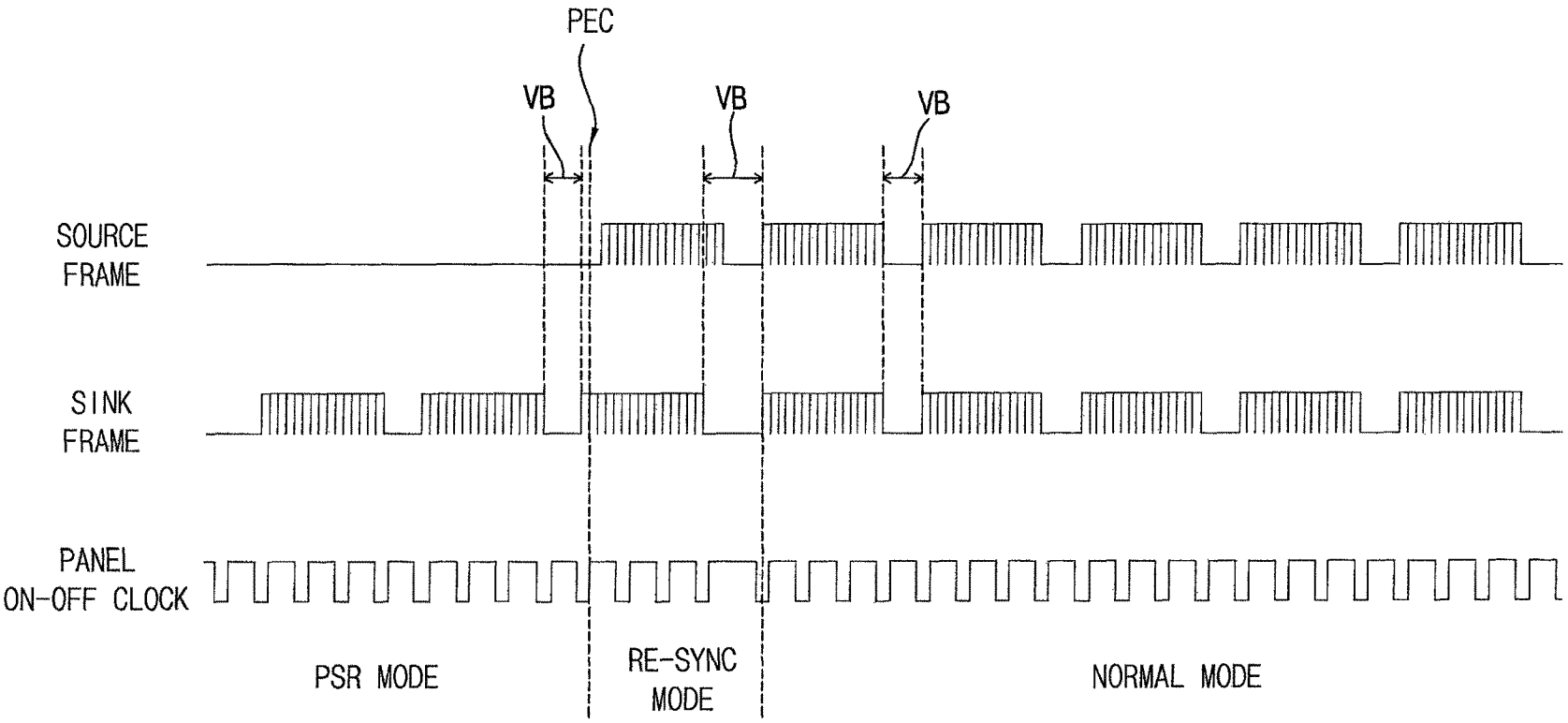
FIG. 7 is a diagram illustrating an example in which a conventional display device performs a frame-timing synchronization operation when a frame timing of a source device lags behind a frame timing of a sink device.

FIG. 6 is a diagram illustrating an example in which the display device of FIG. 1 performs a frame-timing synchronization operation when a frame timing of a source device lags behind a frame timing of a sink device. FIG. 7 is a diagram illustrating an example in which a conventional display device performs a frame-timing synchronization operation when a frame timing of a source device lags behind a frame timing of a sink device.

Referring to FIGS. 6 and 7, the frame-timing synchronization operation may be performed when the frame timing of the source device 120 lags behind the frame timing of the sink device 140. That is, after the operating mode of the display device 100 is changed from the PSR mode 240 to the re-synchronization mode 260 as the PSR-exiting command PEC is generated, a rising edge of the image data (e.g., indicated by SOURCE FRAME) output from the source device 120 may lag behind a rising edge of the still image data (e.g., indicated by SINK FRAME) output from the remote frame buffer 142 of the sink device 140.

As illustrated in FIG. 7, after the operating mode is changed from the PSR mode to the re-synchronization mode as the PSR-exiting command PEC is generated, the conventional display device needs to increase a length of a vertical blank period of a given frame of the sink device (e.g., indicated by VB and VB') because the conventional display device needs to increase a length of the given frame of the sink device to synchronize the frame timing of the sink device with the frame timing of the source device in the re-synchronization mode when the frame timing of the source device lags behind the frame timing of the sink device. However, in the conventional display device, because the panel on-off clock is distorted (e.g., sharply stretched) in the vertical blank period of the given frame without changing a panel-on-time ratio of the panel on-off clock, luminance of the given frame is changed, and thus a perceptible flicker is caused by the luminance-change of the given frame.

On the other hand, the display device 100 of the present embodiment may reduce or prevent the flicker due to the length-change of the vertical blank period of the given frame of the sink device, which is caused in the re-synchronization mode of the conventional display device, by dividing the frame-timing synchronization operation performed in the re-synchronization mode 260 into a first period FP, in which a length-change $\alpha$ of a vertical blank period of an adjustment-target frame ATM of the sink device 140 is measured, a second period SP, in which a temporary panel on-off clock (e.g., indicated by PANEL ON-OFF CLOCK) to be applied to the adjustment-target frame ATM of the sink device 140 is determined by reflecting the length-change $\alpha$ to equalize a panel-on-time ratio of the adjustment-target frame ATM of the sink device 140 with a panel-on-time ratio of a normal frame NFM of the sink device 140, and a third period TP, in which the temporary panel on-off clock is applied to the adjustment-target frame ATM of the sink device 140 when the adjustment-target frame ATM of the sink device 140 is implemented.

For example, as illustrated in FIG. 6, the first period FP may be from a first rising edge of the image data output from the source device 120 to a second rising edge of the image data output from the source device 120. That is, the first period FP may include one frame of the image frame output from the source device 120, and a portion of one frame of the still image data (e.g., the normal frame NFM of the sink device 140) output from the remote frame buffer 142 of the sink device 140.

During the first period FP, the length-change $\alpha$ of the vertical blank period of the adjustment-target frame ATM of the sink device 140 may be measured. That is, the length-change $\alpha$ may be a period from a second rising edge of the still image data output from the remote frame buffer 142 of the sink device 140 to a second rising edge of the image data output from the source device 120, and a length of the adjustment-target frame ATM of the sink device 140 may be a value generated by adding the length-change $\alpha$ to a length of the normal frame NFM of the sink device 140.

During the first period FP, a panel-on-time a of one frame of the source device 120 may be measured (e.g., indicated by MEASURE a), and a panel-on-time b of the adjustment-target frame ATM of the sink device 140 may be measured (e.g., indicated by MEASURE b). Because a length of the adjustment-target frame ATM of the sink device 140 is longer than that of the normal frame NFM of the sink device 140, the panel-on-time b of the adjustment-target frame ATM of the sink device 140 may not be completely measured during the first period FP. Thus, the measured panel-on-time b of the adjustment-target frame ATM of the sink device 140 may correspond to the panel-on-time a of the normal frame NFM of the sink device 140. Here, the panel-on-time a of the normal frame NFM of the sink device 140 may be substantially the same as the panel-on-time a of one frame of the source device 120.

In addition, as illustrated in FIG. 6, the second period SP may be from the second rising edge of the image data output from the source device 120 to a second rising edge of the still image data output from the remote frame buffer 142 of the sink device 140. That is, the second period SP may include a portion of one frame of the still image data (e.g., the normal frame NFM of the sink device 140) output from the remote frame buffer 142 of the sink device 140.

During the second period SP, the temporary panel on-off clock to be applied to the adjustment-target frame ATM of the sink device 140 may be determined by reflecting the length-change α to equalize the panel-on-time ratio of the adjustment-target frame ATM of the sink device 140 (e.g., (b+k)/(1frame+α)) with the panel-on-time ratio of the normal frame NFM of the sink device 140 (e.g., a/1frame). In other words, because the length of the normal frame NFM of the sink device 140 (e.g., 1frame) and the panel-on-time b of the adjustment-target frame ATM of the sink device 140 are grasped (i.e., known, figured out, etc), a variable k that satisfies an equation a/1frame=(b+k)/(1frame+α) may be calculated when the length-change α is reflected. Here, the panel-on-time of the temporary panel on-off clock to be applied to the adjustment-target frame ATM of the sink device 140 may be (b+k). Thus, the pulse width of the temporary panel on-off clock to be applied to the adjustment-target frame ATM of the sink device 140 in the third period TP may be larger than the pulse width of the panel on-off clock applied to the normal frame NFM of the sink device 140 in the PSR mode 240, the normal mode 220, and the first and second periods FP and SP of the re-synchronization mode 260.

Further, as illustrated in FIG. 6, the third period TP may be from the second rising edge of the still image data output from the remote frame buffer 142 of the sink device 140 to a fourth rising edge of the image data output from the source device 120. That is, the third period TP may include the adjustment-target frame ATM of the sink device 140.

During the third period TP, the temporary panel on-off clock may be applied to the adjustment-target frame ATM of the sink device 140. As a result, the panel-on-time ratio of the adjustment-target frame ATM of the sink device 140 may be equalized with the panel-on-time ratio of the normal frame NFM of the sink device 140 even though the length of the adjustment-target frame ATM of the sink device 140 is different from the length of the normal frame NFM of the sink device 140. That is, the duty ratio of the temporary panel on-off clock applied to the adjustment-target frame ATM of the sink device 140 may be equalized with the duty ratio of the panel on-off clock applied to the normal frame NFM of the sink device 140 even though the pulse width of the panel on-off clock applied to the normal frame NFM of the sink device 140 is different from the pulse width of the temporary panel on-off clock applied to the adjustment-target frame ATM of the sink device 140. Thus, luminance of the normal frame NFM of the sink device 140 may be equal to luminance of the adjustment-target frame ATM of the sink device 140. As a result, a flicker that a user can perceive may not be caused although the length-change of the vertical blank period of the adjustment-target frame ATM of the sink device 140 occurs.

Next, as the operating mode of the display device 100 is changed from the re-synchronization mode 260 to the normal mode 220 at a time when the third period TP ends, the sink device 140 may perform a displaying operation based on the image data output from the source device 120.

Figure 8:
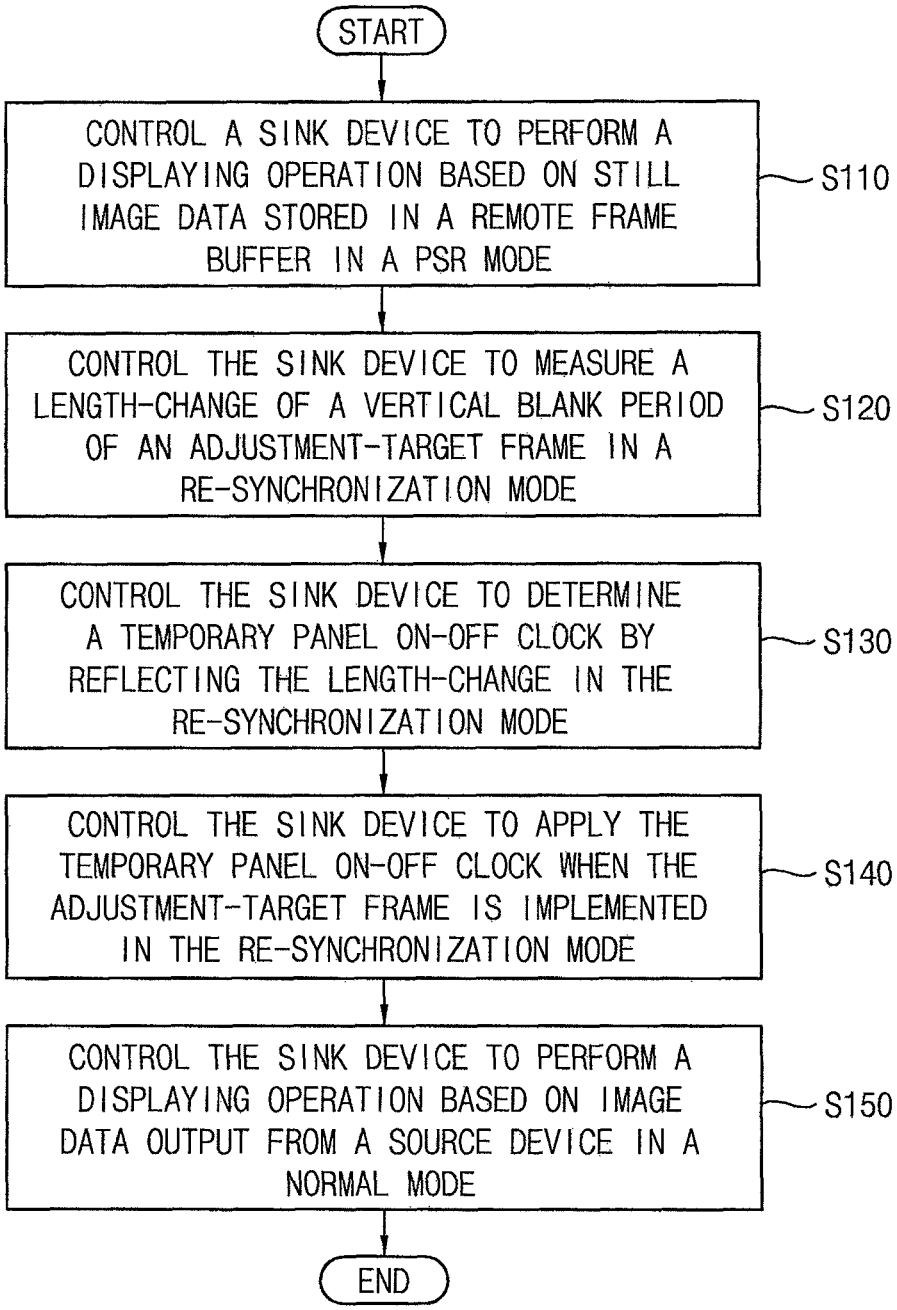
FIG. 8 is a flowchart illustrating a method of operating a display device according to embodiments.

FIG. 8 is a flowchart illustrating a method of operating a display device according to embodiments.

Referring to FIG. 8, the method of FIG. 8, where an operating mode of the display device is changed from a PSR mode to a normal mode through a re-synchronization mode in performing a PSR function, may control a sink device to perform a displaying operation based on still image data stored in a remote frame buffer of the sink device in the PSR mode (S110), may control the sink device to measure a length-change of a vertical blank period of an adjustment-target frame of the sink device in the re-synchronization mode (S120), may control the sink device to determine a temporary panel on-off clock to be applied to the adjustment-target frame of the sink device by reflecting the length-change of the vertical blank period of the adjustment-target frame of the sink device to equalize a panel-on-time ratio of the adjustment-target ratio of the sink device with a panel-on-time ratio of a normal frame of the sink device in the re-synchronization mode (S130), may control the sink device to apply the temporary panel on-off clock when the adjustment-target frame of the sink device is implemented in the re-synchronization mode (S140), and may control the sink device to perform a displaying operation based on image data output from a source device in the normal mode (S150).

In other words, the method of FIG. 8 may equalize luminance of the adjustment-target frame of the sink device with luminance of the normal frame of the sink device by equalizing a panel-on-time ratio of the adjustment-target frame of the sink device with a panel-on-time ratio of the normal frame of the sink device even though a length of the normal frame of the sink device is different from a length of the adjustment-target frame of the sink device (e.g., by equalizing a duty ratio of the temporary panel on-off clock applied to the adjustment-target frame of the sink device with a duty ratio of the panel on-off clock applied to the normal frame of the sink device even though a pulse width of the panel on-off clock applied to the normal frame of the sink device is different from a pulse width of the temporary panel on-off clock applied to the adjustment-target frame of the sink device). Thus, the method of FIG. 8 may reduce or prevent a flicker due to the length-change of the vertical blank period of the adjustment-target frame of the sink device.

In an embodiment, when the frame timing of the source device leads the frame timing of the sink device, the method of FIG. 8 may control the sink device to measure the length-change of the vertical blank period of the adjustment-target frame of the sink device during a period from a first rising edge of the image data output from the source device to a second rising edge of the still image data output from the remote frame buffer of the sink device, may control the sink device to determine the temporary panel on-off clock during a period from the second rising edge of the still image data output from the remote frame buffer of the sink device to a third rising edge of the still image data output from the remote frame buffer of the sink device, and may control the sink device to apply the temporary panel on-off clock during a period from the third rising edge of the still image data output from the remote frame buffer of the sink device to a fourth rising edge of the image data output from the source device.

In another embodiment, when the frame timing of the source device lags behind the frame timing of the sink device, the method of FIG. 8 may control the sink device to measure the length-change of the vertical blank period of the adjustment-target frame of the sink device during a period from a first rising edge of the image data output from the source device to a second rising edge of the image data output from the source device, may control the sink device to determine the temporary panel on-off clock during a period from the second rising edge of the image data output from the source device to a second rising edge of the still image data output from the remote frame buffer of the sink device, and may control the sink device to apply the temporary panel on-off clock during a period from the second rising edge of the still image data output from the remote frame buffer of the sink device to a fourth rising edge of the image data output from the source device. Because the above embodiments are described above, duplicated description will not be repeated.

Figure 9:
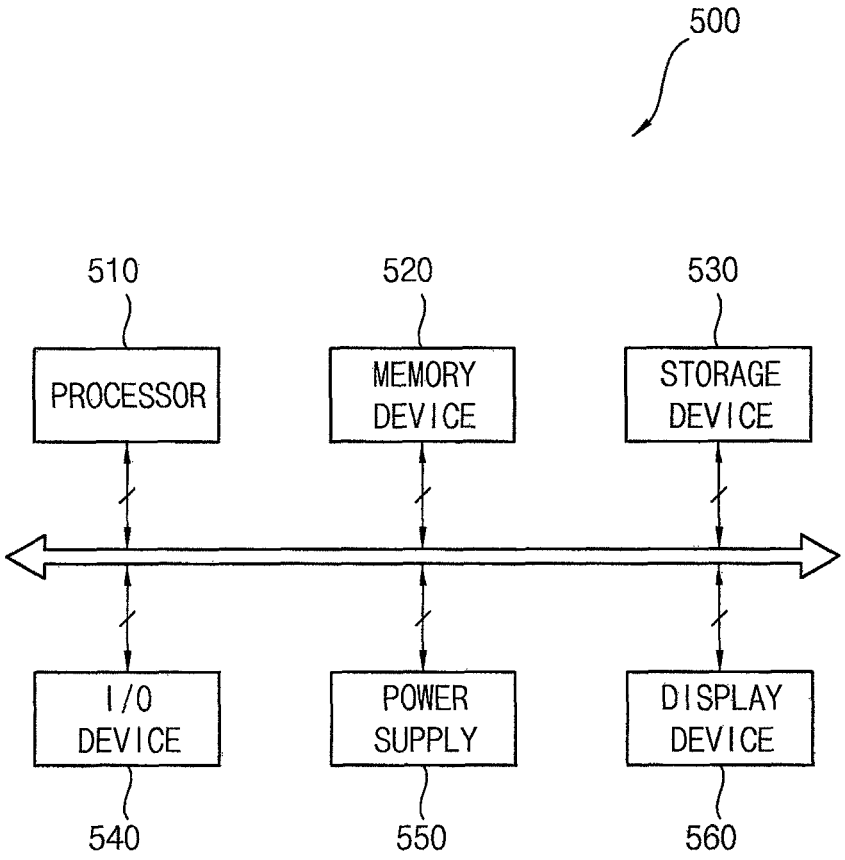
FIG. 9 is a block diagram illustrating an electronic device according to embodiments.
Figure 10:
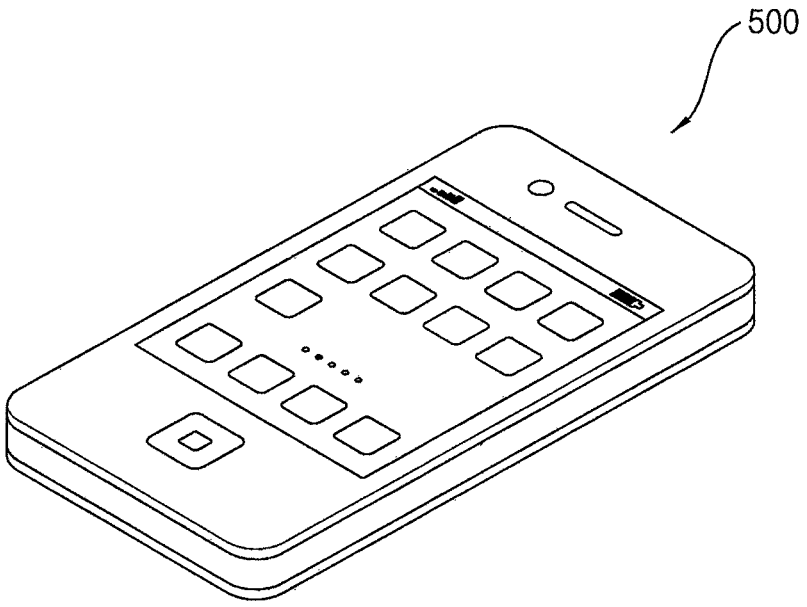
FIG. 10 is a perspective view of an example in which the electronic device of FIG. 9 is implemented as a smart phone.

FIG. 9 is a block diagram illustrating an electronic device according to embodiments. FIG. 10 is a perspective view of an example in which the electronic device of FIG. 9 is implemented as a smart phone.

Referring to FIGS. 9 and 10, the electronic device 500 may include a processor 510, a memory device 520, a storage device 530, an input/output (I/O) device 540, a power supply 550, and a display device 560. Here, the display device 560 may be the display device 100 of FIG. 1. In addition, the electronic device 500 may further include a plurality of ports for communicating a video card, a sound card, a memory card, a universal serial bus (USB) device, other electronic devices, etc. In an embodiment, as illustrated in FIG. 10, the electronic device 500 may be implemented as a smart phone. In another embodiment, the electronic device 500 may be implemented as a digital camera (e.g., a mirror-less digital camera). However, the electronic device 500 is not limited thereto. For example, the electronic device 500 may be implemented as a cellular phone, a video phone, a smart pad, a smart watch, a tablet PC, a car navigation system, a television, a computer monitor, a laptop, a digital camera, a head mounted display (HMD) device, etc.

The processor 510 may perform various computing functions. The processor 510 may be a microprocessor, a central processing unit (CPU), an application processor (AP), etc. The processor 510 may be coupled to other components via an address bus, a control bus, a data bus, etc. Further, the processor 510 may be coupled to an extended bus such as a peripheral component interconnection (PCI) bus. The memory device 520 may store data for an operation of the electronic device 500. For example, the memory device 520 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile DRAM device, etc. The storage device 530 may be a solid state drive (SSD) device, a hard disk drive (HDD) device, a CD-ROM device, etc. The I/O device 540 may include an input device such as a keyboard, a keypad, a mouse device, a touchpad, a touch-screen, etc., and an output device such as a printer, a speaker, etc. In some embodiments, the display device 560 may be included in the I/O device 540. The power supply 550 may provide power for the operation of the electronic device 500.

The display device 560 may be coupled to other components via the buses or other communication links. As described above, the display device 560 may include a source device and a sink device that perform a PSR function, and the source device and the sink device may perform data transmission based on an eDP interface. For example, the source device may output image data in a normal mode and a re-synchronization mode, while not outputting the image data in a PSR mode. The sink device may perform a displaying operation based on the image data output from the source device in the normal mode. The sink device may store the image data as still image data in a remote frame buffer at a time when an operating mode is changed from the normal mode to the PSR mode in response to a PSR-entering command. The sink device may perform a displaying operation based on the still image data output from the remote frame buffer in the PSR mode. In addition, the sink device may perform a frame-timing synchronization operation for synchronizing a frame timing of the sink device with a frame timing of the source device in the re-synchronization mode as the operation mode is changed from the PSR mode to the normal mode through the re-synchronization mode in response to a PSR-exiting command.

Here, the frame-timing synchronization operation performed in the re-synchronization mode may include a first period in which a length-change of a vertical blank period of an adjustment-target frame of the sink device is measured, a second period in which a temporary panel on-off clock to be applied to the adjustment-target frame of the sink device is determined by reflecting the length-change of the vertical blank period of the adjustment-target frame of the sink device to equalize a panel-on-time ratio of the adjustment-target frame of the sink device with a panel-on-time ratio of a normal frame of the sink device, and a third period in which the temporary panel on-off clock is applied to the adjustment-target frame of the sink device when the adjustment-target frame of the sink device is implemented. As a result, the display device 560 may reduce or prevent a flicker due to a length-change of a vertical blank period of a given frame of the sink device, which is otherwise caused in a re-synchronization mode of a conventional display device. Because the display device 560 is described above, duplicated description will not be repeated.

The present inventive concept may be applied to a display device and an electronic device including the display device. For example, the present inventive concept may be applied to a cellular phone, a smart phone, a video phone, a smart pad, a smart watch, a tablet PC, a car navigation system, a television, a computer monitor, a laptop, a digital camera, a head mounted display device, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various embodiments and is not to be construed as limited to the embodiments disclosed, and that modifications to the disclosed embodiments, as well as other embodiments, are intended to be included within the scope of the appended claims, functional equivalents thereof to be included therein.

What is claimed is:

1. A display device comprising:

a source device configured to:

output image data in a normal mode and in a re-synchronization mode; and refrain from outputting the image data in a panel self-refresh (PSR) mode; and a sink device configured to:

perform a displaying operation based on the image data in the normal mode;

store the image data as still image data in a remote frame buffer at a time when an operating mode is changed from the normal mode to the PSR mode in response to a PSR-entering command;

perform the displaying operation based on the still image data in the PSR mode; and perform a frame-timing synchronization operation for synchronizing a frame timing of the sink device with a frame timing of the source device in the re-synchronization mode when the operating mode is changed from the PSR mode to the normal mode through the re-synchronization mode in response to a PSR-exiting command, wherein the frame-timing synchronization operation comprises:

a first period in which a length-change of a vertical blank period of an adjustment-target frame of the sink device is measured;

a second period in which a temporary panel on-off clock to be applied to the adjustment-target frame is determined by reflecting the length-change to equalize a panel-on-time ratio of the adjustment-target frame with a panel-on-time ratio of a normal frame of the sink device; and a third period in which the temporary panel on-off clock is applied to the adjustment-target frame when the adjustment-target frame is implemented.

2. The display device of claim 1, wherein the source device is further configured to:

cease outputting the image data to the sink device when the PSR mode is started in response to the PSR-entering command; and begin outputting the image data to the sink device when the re-synchronization mode is started in response to the PSR-exiting command.

3. The display device of claim 2, wherein the sink device is configured to continue to perform the displaying operation based on the still image data before the operating mode is changed from the re-synchronization mode to the normal mode.

4. The display device of claim 1, wherein a duty ratio of the temporary panel on-off clock is equal to a duty ratio of a normal panel on-off clock.

5. The display device of claim 4, wherein the first period is from a first rising edge of the image data output from the source device to a second rising edge of the still image data output from the remote frame buffer when the frame timing of the source device leads the frame timing of the sink device.

6. The display device of claim 5, wherein the second period is from the second rising edge of the still image data output from the remote frame buffer to a third rising edge of the still image data output from the remote frame buffer when the frame timing of the source device leads the frame timing of the sink device.

7. The display device of claim 6, wherein the third period is from the third rising edge of the still image data output from the remote frame buffer to a fourth rising edge of the image data output from the source device when the frame timing of the source device leads the frame timing of the sink device.

8. The display device of claim 7, wherein a pulse width of the temporary panel on-off clock is smaller than a pulse width of the normal panel on-off clock applied to the normal frame in the PSR mode, in the normal mode, and in the first and second periods of the re-synchronization mode when the frame timing of the source device leads the frame timing of the sink device.

9. The display device of claim 4, wherein the first period is from a first rising edge of the image data output from the source device to a second rising edge of the image data output from the source device when the frame timing of the source device lags behind the frame timing of the sink device.

10. The display device of claim 9, wherein the second period is from the second rising edge of the image data output from the source device to a second rising edge of the still image data output from the remote frame buffer when the frame timing of the source device lags behind the frame timing of the sink device.

11. The display device of claim 10, wherein the third period is from the second rising edge of the still image data output from the remote frame buffer to a fourth rising edge of the image data output from the source device when the frame timing of the source device lags behind the frame timing of the sink device.

12. The display device of claim 11, wherein a pulse width of the temporary panel on-off clock is larger than a pulse width of the normal panel on-off clock applied to the normal frame in the PSR mode, in the normal mode, and in the first and second periods of the re-synchronization mode when the frame timing of the source device lags behind the frame timing of the sink device.

13. A method of operating a display device of which an operating mode is changed from a PSR mode to a normal mode through a re-synchronization mode in performing a panel self-refresh (PSR) function, the method comprising:

controlling a sink device to perform a displaying operation based on still image data stored in a remote frame buffer of the sink device in the PSR mode;

controlling the sink device to measure a length-change of a vertical blank period of an adjustment-target frame of the sink device in the re-synchronization mode;

controlling the sink device to determine a temporary panel on-off clock to be applied to the adjustment-target frame by reflecting the length-change to equalize a panel-on-time ratio of the adjustment-target frame with a panel-on-time ratio of a normal frame of the sink device in the re-synchronization mode;

controlling the sink device to apply the temporary panel on-off clock to the adjustment-target frame when the adjustment-target frame is implemented in the re-synchronization mode; and controlling the sink device to perform the displaying operation based on image data output from a source device in the normal mode.

14. The method of claim 13, wherein a duty ratio of the temporary panel on-off clock is equal to a duty ratio of a normal panel on-off clock.

15. The method of claim 14, further comprising controlling the sink device to measure the length-change during a period from a first rising edge of the image data output from the source device to a second rising edge of the still image data output from the remote frame buffer when a frame timing of the source device leads a frame timing of the sink device.

16. The method of claim 15, further comprising controlling the sink device to determine the temporary panel on-off clock during a period from the second rising edge of the still image data output from the remote frame buffer to a third rising edge of the still image data output from the remote frame buffer when the frame timing of the source device leads the frame timing of the sink device.

17. The method of claim 16, further comprising controlling the sink device to apply the temporary panel on-off clock to the adjustment-target frame during a period from the third rising edge of the still image data output from the remote frame buffer to a fourth rising edge of the image data output from the source device when the frame timing of the source device leads the frame timing of the sink device.

18. The method of claim 14, further comprising controlling the sink device to measure the length-change during a period from a first rising edge of the image data output from the source device to a second rising edge of the image data output from the source device when a frame timing of the source device lags behind a frame timing of the sink device.

19. The method of claim 18, further comprising controlling the sink device to determine the temporary panel on-off clock during a period from the second rising edge of the image data output from the source device to a second rising edge of the still image data output from the remote frame buffer when the frame timing of the source device lags behind the frame timing of the sink device.

20. The method of claim 19, further comprising controlling the sink device to apply the temporary panel on-off clock to the adjustment-target frame during a period from the second rising edge of the still image data output from the remote frame buffer to a fourth rising edge of the image data output from the source device when the frame timing of the source device lags behind the frame timing of the sink device.

* * * * *